US008726554B2

(12) United States Patent
Klassen

(10) Patent No.: US 8,726,554 B2
(45) Date of Patent: May 20, 2014

(54) MAGAZINE WELL ADAPTER AND KIT

(76) Inventor: David Klassen, Akron, OH (US)

( * ) Notice: Subject to any disclaimer, the term of this patent is extended or adjusted under 35 U.S.C. 154(b) by 12 days.

(21) Appl. No.: 13/432,453

(22) Filed: Mar. 28, 2012

(65) Prior Publication Data

US 2012/0255209 A1 Oct. 11, 2012

Related U.S. Application Data

(60) Provisional application No. 61/468,881, filed on Mar. 29, 2011.

(51) Int. Cl.
*F41A 35/00* (2006.01)
*F41A 9/61* (2006.01)
*F41A 17/38* (2006.01)

(52) U.S. Cl.
CPC ..... *F41A 17/38* (2013.01)
USPC ..... 42/6

(58) Field of Classification Search
USPC ..... 42/6, 49.01, 49.02, 50, 90, 106, 85, 87, 42/18; 89/33.1, 128
See application file for complete search history.

(56) References Cited

U.S. PATENT DOCUMENTS

| | | | | | |
|---|---|---|---|---|---|
| 989,560 | A * | 4/1911 | Horchardt | 42/18 |
| 2,363,772 | A * | 11/1944 | Browning | 89/138 |
| 2,956,363 | A * | 10/1960 | Montana | 42/50 |
| 3,005,279 | A * | 10/1961 | Brewer | 42/18 |
| 3,603,020 | A * | 9/1971 | Wiese | 42/50 |
| 6,070,352 | A * | 6/2000 | Daigle | 42/49.02 |
| 8,104,209 | B1 * | 1/2012 | Bentley et al. | 42/49.01 |
| 8,127,480 | B1 * | 3/2012 | McManus et al. | 42/49.02 |
| 8,418,390 | B1 * | 4/2013 | Wright | 42/49.01 |
| 2006/0123683 | A1 * | 6/2006 | Garrett et al. | 42/6 |
| 2009/0107023 | A1 * | 4/2009 | Murphy | 42/69.02 |
| 2010/0154275 | A1 * | 6/2010 | Faifer | 42/90 |
| 2011/0232148 | A1 * | 9/2011 | Cain et al. | 42/6 |

OTHER PUBLICATIONS

Texas AK Designs, AR to AK Mag Adapter, Website Page www.texasakdesigns.com.
Polish apparatus, photographs, source unknown.

* cited by examiner

*Primary Examiner* — Reginald Tillman, Jr.
(74) *Attorney, Agent, or Firm* — Hahn Loeser & Parks LLP

(57) ABSTRACT

The magazine well adapter of the present invention, and associated kits and devices, improves the firing rate and accuracy of AK-type firearms by converting the traditional magazine well into a push-button drop ejection device.

12 Claims, 15 Drawing Sheets

MAGAZINE WELL ADAPTER AND KIT

CROSS-REFERENCE TO RELATED APPLICATIONS

This application claims the benefit of U.S. Provisional Application No. 61/468,881, titled MAG-WELL, filed Mar. 29, 2011, which is herein incorporated by reference.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

1. Field of the Invention

This invention relates generally to the art of firearms, and more specifically, to an adapter for an automatic rifle's magazine well that increases firing rate, shooting accuracy, and accommodates the use of a multi-rifle ("universal") ammunition magazine.

2. Description of Related Art

The Avtomat Kalishnikova, commonly known as the "AK-47" or "Kalishnikov." is the world's most ubiquitous assault rifle. Indeed, since its development and deployment as a Soviet Armed Forces rifle in 1947, the AK-47 (and its variants) has been widely embraced due to their durability, low production cost, and ease of use. In fact, more AK-type rifles have been manufactured since 1947 than all other assault rifles combined. Of the estimated 500 million firearms in existence worldwide, approximately 100 million belong to the Kalishnikov family, with the AK-47 accounting for fully three-quarters of that total.

Originally designed for ease of operation and repair by glove-wearing Soviet soldiers in arctic conditions, the firearm's breathtaking simplicity makes it a common choice of both armed and special forces and individual gun owners and enthusiasts alike. Although the AK-47 is generally regarded as less accurate, less safe, and of limited shooting range in comparison to similarly calibrated firearms, its ease of operation, robustness to mistreatment, and negligible failure rate have firmly entrenched the weapon as the world's most popular small arms device.

As illustrated in FIG. 1, the AK-47 (shown as a type-2 variation of the first Soviet model) is a selective-fire, gas operated 7.62×39 mm assault rifle that, in its original formulations, is easily recognizable by its wooden furniture consisting of a wood covered buttstock 2, pistol grip 4, and forend 6. However, AK-style firearms have evolved over time to implement an extensive number of component changes and alterations, with modifications to, at least, the receiver, buttstock, ammunition caliber, pistol grip, sights, and materials. These changes are reflected in a wide variety of AK-47 variants which include, but are not limited to, firearms going by the common names of AK-47 (1948-51 models), AK-47 (1952 model), AKS, RPK, AKM, AKMS, AK-74 series (5.45 v 39 mm), AK-101/AK-102 series, AK-103/AK-104 series, AK-107/AK-108 series, AK-200 series, Saiga semi-automatic rifle and shotgun, and KSK shotgun. Additionally, military AK-type variants are produced in countries across the globe, from the Finnish RK 62, to the Israeli IMI Galil, to the Hungarian AK-55, to the Chinese AK-56 and the Serbian M92 (with numerous other nations, and their version, not listed but contemplated in referencing the gun). As would be understood by a person of ordinary skill in the art, the AK-47 and all variants are intended to be covered when using the phrases AK-47, AK-type. AK-style, and/or AK-47 variants.

As is well known to a person of ordinary skill in the art, to fire an AK-47, or one of its variants, the operator inserts a magazine 8 loaded with bullets/cartridges/rounds 34 into the magazine well 10 of the receiver 12, moves the selector lever 66 to the lowest position, pulls back and releases the charging handle, aims, and then pulls the trigger 20. As each bullet travels through the barrel 50, a portion of the gases expanding behind it is diverted into the gas tube above the barrel 50, where it impacts the gas piston. The piston, in turn, is driven backward, pushing the bolt carrier, which causes the bolt 32 to move backwards, ejecting the spent round, and chambering a new round when the recoil spring pushes it back. Depending on the model being used and the selector setting, the firearm fires only once (semi-automatic), requiring the trigger to be released and depressed again for the next shot. With the selector in the middle position (full-automatic), however, the rifle continues to fire, automatically cycling fresh rounds into the chamber 36, until the magazine is exhausted or pressure is released from the trigger 20. The phrase "semi-automatic rifle" is hereinafter used to refer to firearms having both semi-automatic and fully automatic capabilities.

While the AK-47 and variants are generally regarded as providing a high rate of fire, the process of reloading an AK-47 has certain disadvantages that provide for less than optimal reload time and positioning. Specifically, to reload the AK-47 after a magazine is emptied of bullets, the firearm must be lowered from the firing position at the shoulder of the user in order to obtain sufficient leverage to remove the emptied magazine, while properly seating a new magazine 8 requires a combination of leverage and dexterity that can be unnecessarily time-consuming.

FIG. 2 is a prior art partial cross-section diagram of an AK-47, and traditional AK-47 ammunition magazine 8, that—without belaboring the various firearm componentry, which are well known in the art—demonstrates generally how an ammunition magazine of the prior art is inserted, secured, and removed from the firearm during the reload process. The AK-47, 1, has a receiver 12 having a bottom wall 14 from the opposite sides of which a pair of side walls 16*a*, 16*b* extend upwardly towards the gas tube 18. The magazine well 10 is a rectangular opening in the bottom wall 14 of the receiver 12 for capturing an ammunition magazine 8 at a height sufficient to permit bolt 32 to strip a cartridge 34 (also referred to as a round or bullet) from the magazine 8 and push the cartridge 34 into firing chamber 36 in barrel 50. A front trunion 40 is affixed within the front of the receiver 12 for securing the barrel 50 to the receiver 12, and has a tab engaging rib 42 extending inwardly into the receiver's magazine well 10. The tab engaging rib 42 works in conjunction with a spring-biased magazine latch 54, as is well known in the art, to secure a standard tabbed ammunition magazine 8 within the magazine well 10 and receiver 12.

The standard tabbed ammunition magazine 8 is designed to store thirty cartridges in stacked double rows. As generally shown in FIG. 3, the magazine 8 is of a size designed to fit securely within the magazine well 10, and consists of an elongated and curved housing 80 having a substantially closed bottom end (BE) and a substantially open top end (TE) and two arcuate side walls 82*a*, 82*b* connected in opposition by a front wall 84 and a rear wall 86. Front magazine wall 84 has an engagement tab 88, while back magazine wall 86 has a magazine catch 90.

As is well known in the art, the magazine's 8 top end (TE) is inserted into the magazine well 10 by tipping housing 80 forward so that the engagement tab 88 comes into contact with the tab engaging rib 42 of the front trunion 40. The catching of engagement tab 88 on the tab engaging rib 42 acts a pivot point for rotating the tabbed magazine 8 in an upward and rearward direction (a rocker-type motion) towards the receiver 12 until the magazine catch 90 snap catches into place above the magazine latch 54 (as is shown in FIG. 2). The magazine is removed by pressing the magazine latch 54 toward the housing 80, and then swinging magazine 8 forward and in a downward direction out of the magazine well 10. These traditional methods of loading ("pivot seating") and unloading ("pivot release") an AK-type firearm with an ammunition magazine are hereinafter referred to as "pivot action."

As a practical matter, the AK-47 must be removed from even the most skilled and experienced firearm operator's shoulder in order to obtain the necessary leverage to properly seat the engagement tab 88 onto the tab engaging rib 42 and swivel the magazine 8 into the receiver's magazine well 10. This has the disadvantage of forcing the user to temporarily aim the weapon away from the target while the weapon is reloaded, and in combat situations is a dangerously time-consuming process. An AK-type firearm that permitted push-button magazine ejection (also referred to as drop release)—without modifying the firearm's receiver—would dramatically improve reload times and permit the operator to maintain their aim during reload.

Additionally, many firearm enthusiast and collectors own and enjoy shooting various versions of AK-type firearms available on the market—many of which have made slight modifications to the receiver 12 that require use of the weapon only in conjunction with their gun specific ammunition magazines. Gun owners would benefit from an ammunition magazine that when used in conjunction with a magazine well adapter of the present invention—could be interchangeably used amongst various AK-type firearms.

Therefore, what is needed is an AK-type firearm magazine well adapter, associated magazines, and adaptor kits, that overcome one or more deficiencies in the prior art.

BRIEF SUMMARY OF THE INVENTION

According to one embodiment of this invention, an apparatus for use with an AK-type firearm, comprises a magazine well adapter having an adapter body with an attachment end adapted to be releasably mated with a magazine well of an associated AK-type firearm, and a receiving end adapted to receive an associated modified ammunition magazine, and a release mechanism adapted to releasably engage the associated modified ammunition magazine.

According to another embodiment, a kit for use with an associated AK-type firearm comprises a magazine well adapter having an adapter body with an attachment end adapted to be received and secured within a magazine well of an associated AK-type firearm, and a receiving end adapted to receive an associated modified ammunition magazine; a release mechanism adapted to releasably engage the associated modified ammunition magazine; and a modified ammunition magazine having a locking component that is selectively engaged by the magazine well adapter's release mechanism.

According to another embodiment, the present invention is an apparatus comprising an unmodified AK-type firearm having a magazine well; a magazine well adapter having an adapter body with an attachment end releasably mated with the magazine well, a receiving end adapted to receive an associated modified ammunition magazine, and a release mechanism adapted to releasably engage the associated modified ammunition magazine; and a modified ammunition magazine releasably secured within the magazine well adapter and magazine well.

The magazine well adapter of the present invention, and the associated ammunition magazines and kits detailed herein, enable owners of AK-type firearms to achieve push-button ejection of an ammunition magazine without modifying the receiver of the firearm. Such push-button ejection allows for the spent magazine to be dropped free of the AK-type firearm without pivot release from the magazine well, and permits reloading without removing the firearm from the user's shoulder.

Another feature of the magazine well adapter of the present invention, and the associated ammunition magazines and kits detailed herein, is that the receiver of an AK-type firearm does not need to be modified in order to load an ammunition magazine without pivot seating, and permits reloading without removing the firearm from the user's shoulder.

Another feature of the magazine well adapter of the present invention, and the associated ammunition magazines and kits detailed herein, is that the magazine well adapter can be installed and removed from the AK-type firearm without modification to the firearm's receiver. Thus, standard tabbed AK-type magazines can still be used when the magazine well adapter is disassembled from the AK-type firearm.

Still another feature of the present invention is that the magazine well adapter's ability to achieve reload without pivot action permits reloading without removing the firearm from the user's shoulder; effectively eliminating unnecessary user motion and decreasing reload time, thus increasing the firing rate of the AK-type firearm, while allowing the user to maintain their aim during reload.

Another feature of the present invention is that a modified ammunition magazine of the kits, detailed herein, can be used interchangeably with various magazine well adapters for a specific AK-type firearm.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION OF THE INVENTION

Figure 1:
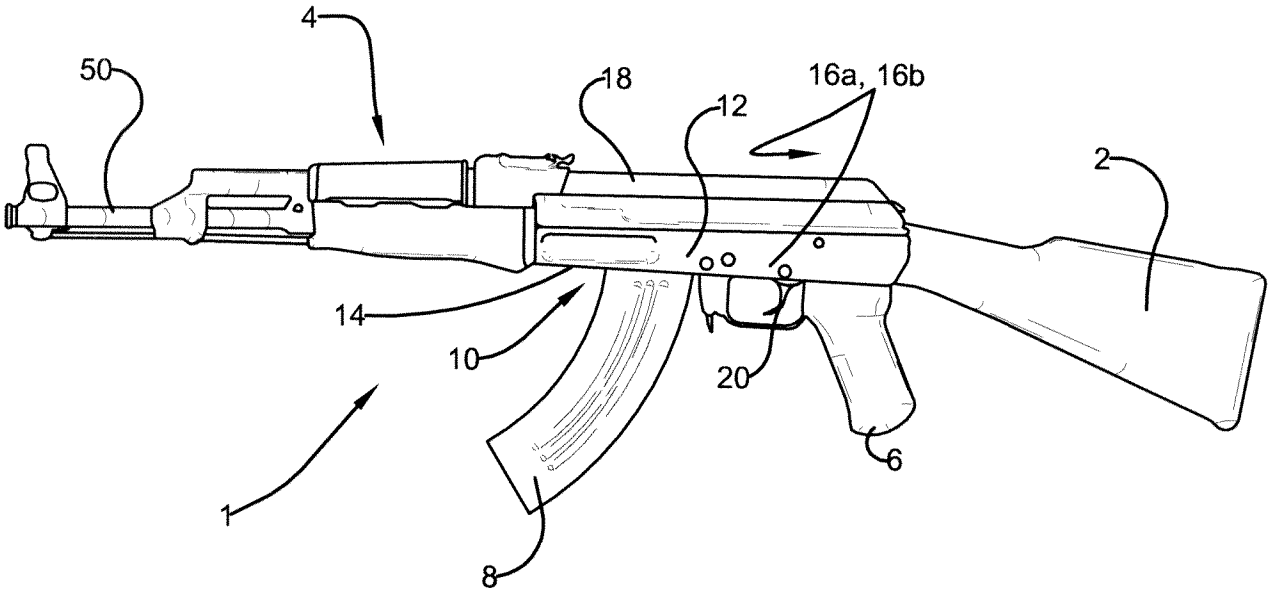
FIG. 1 shows a perspective view of an AK-47 assault rifle of the prior art.
Figure 2:
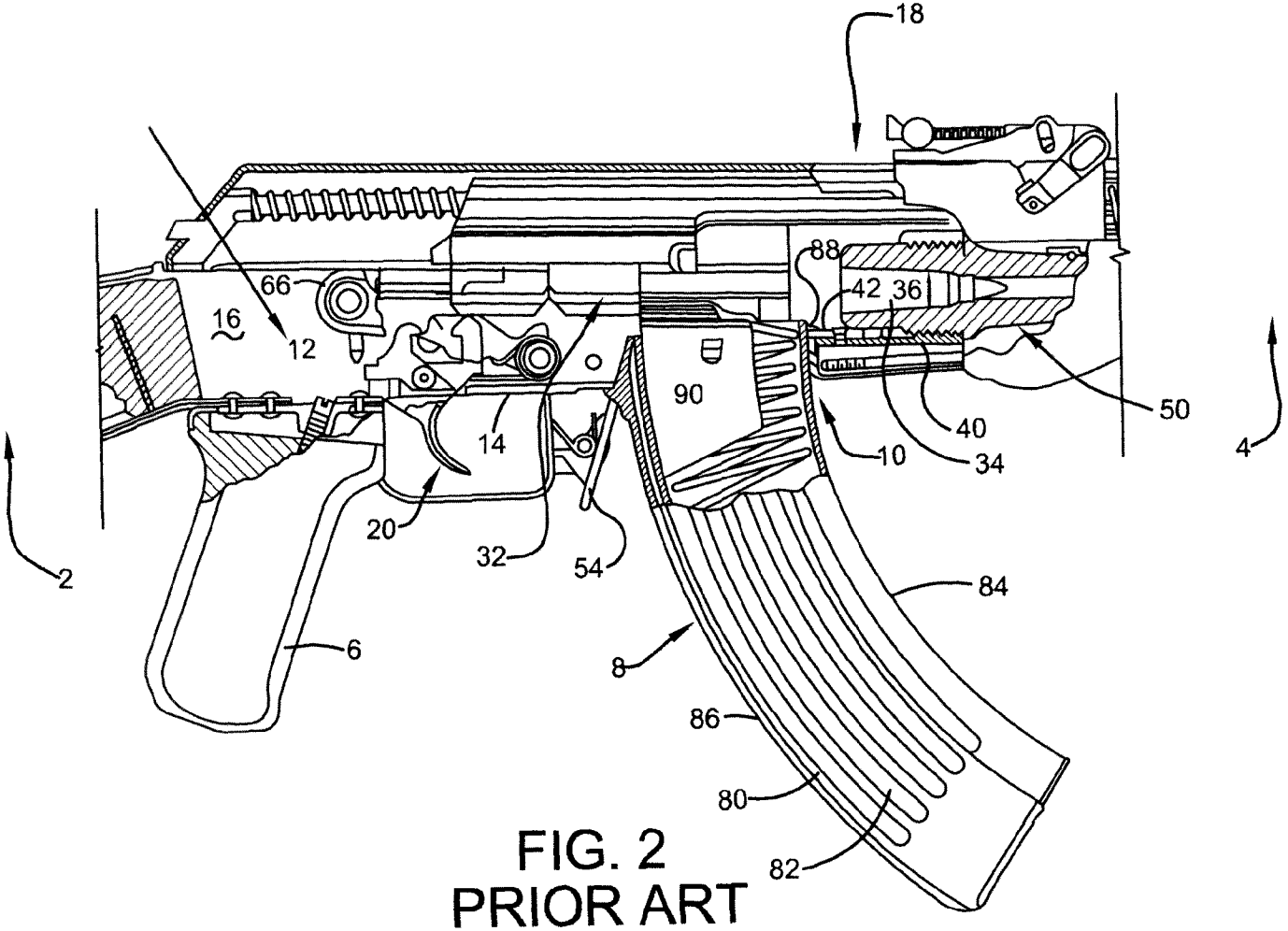
FIG. 2 PRIOR ART
FIG. 2 shows a partial cross-sectional side view of an AK-47 and installed ammunition magazine of the prior art.
Figure 3:
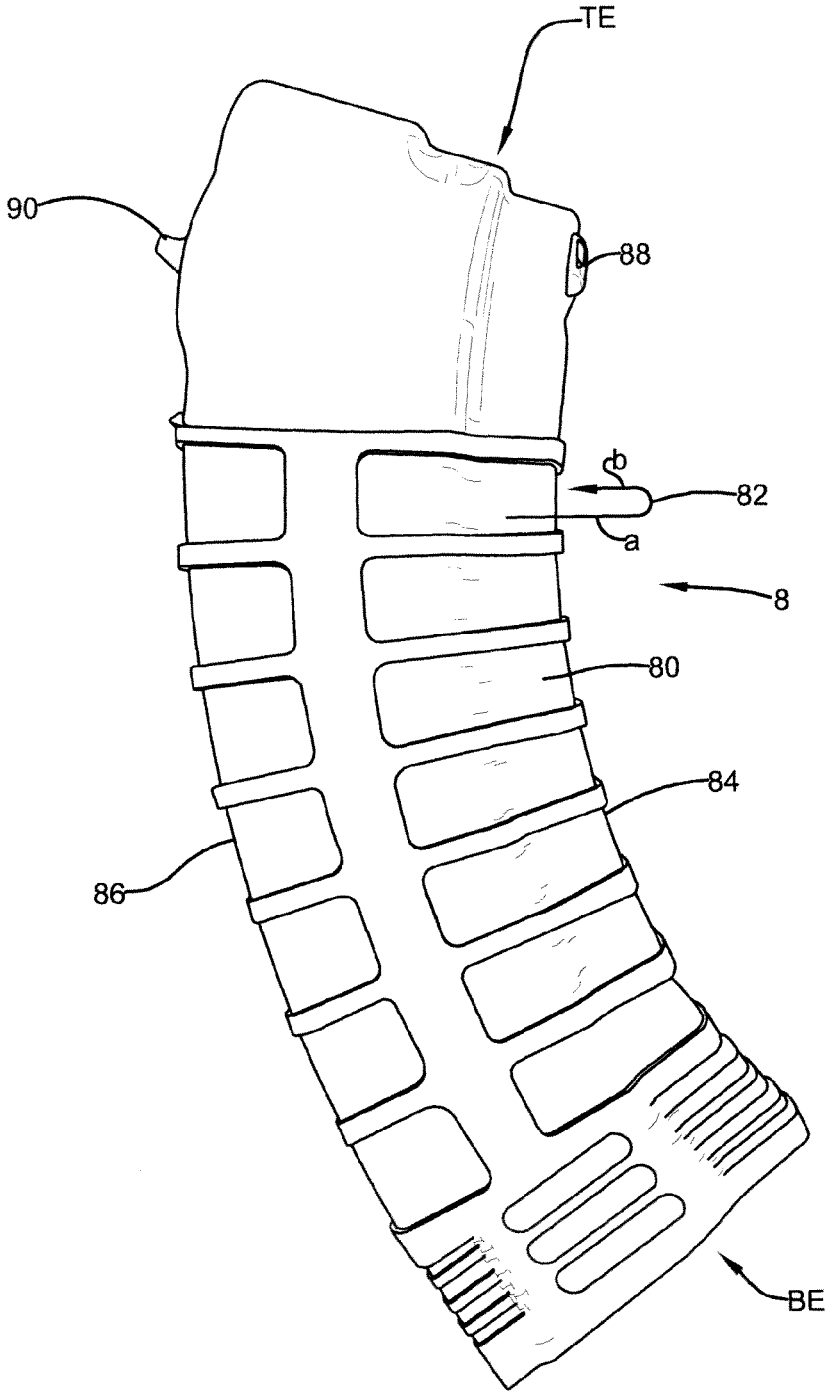
FIG. 3 PRIOR ART
FIG. 3 shows a perspective view of a standard tabbed AK-47 ammunition magazine of the prior art.
Figure 4:
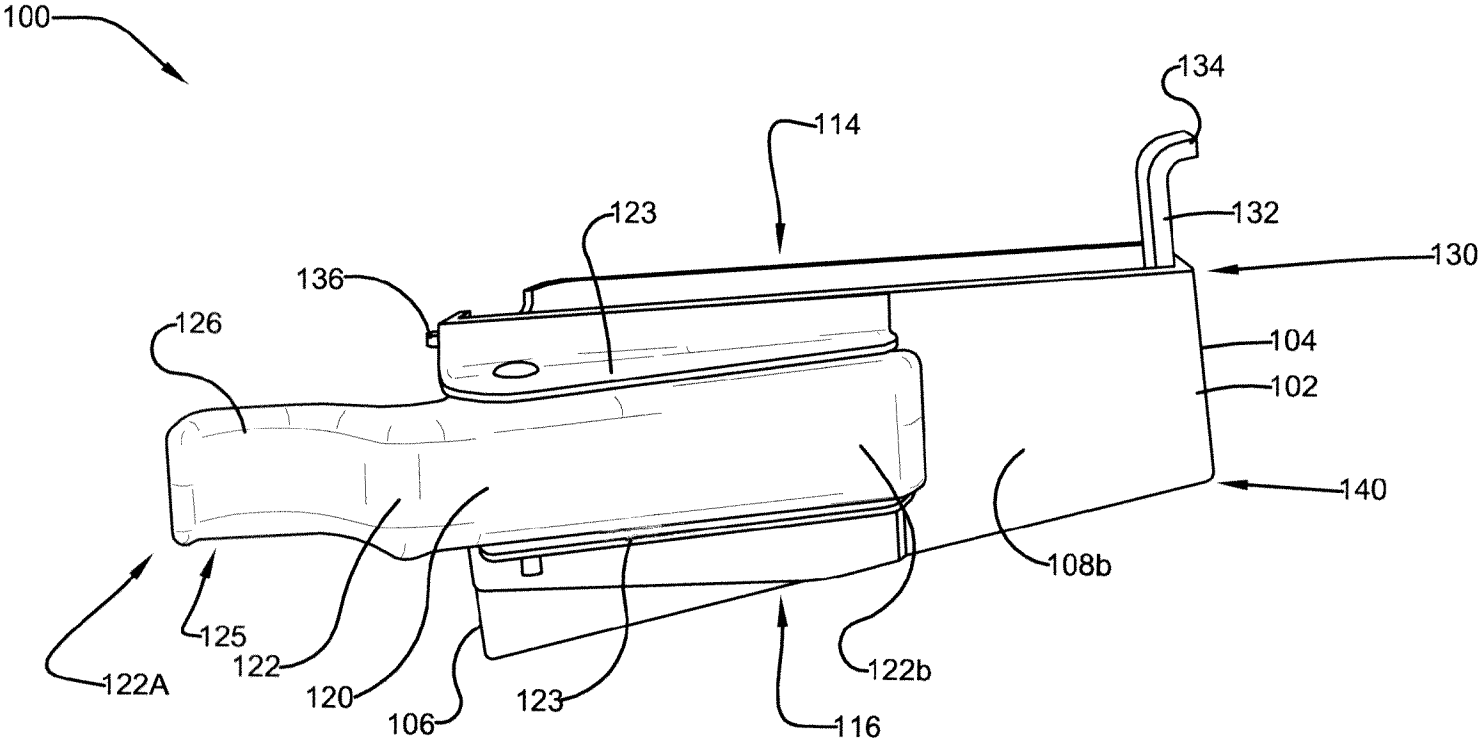
FIG. 4 shows a side view of the magazine well adapter according to one embodiment.
Figure 5:
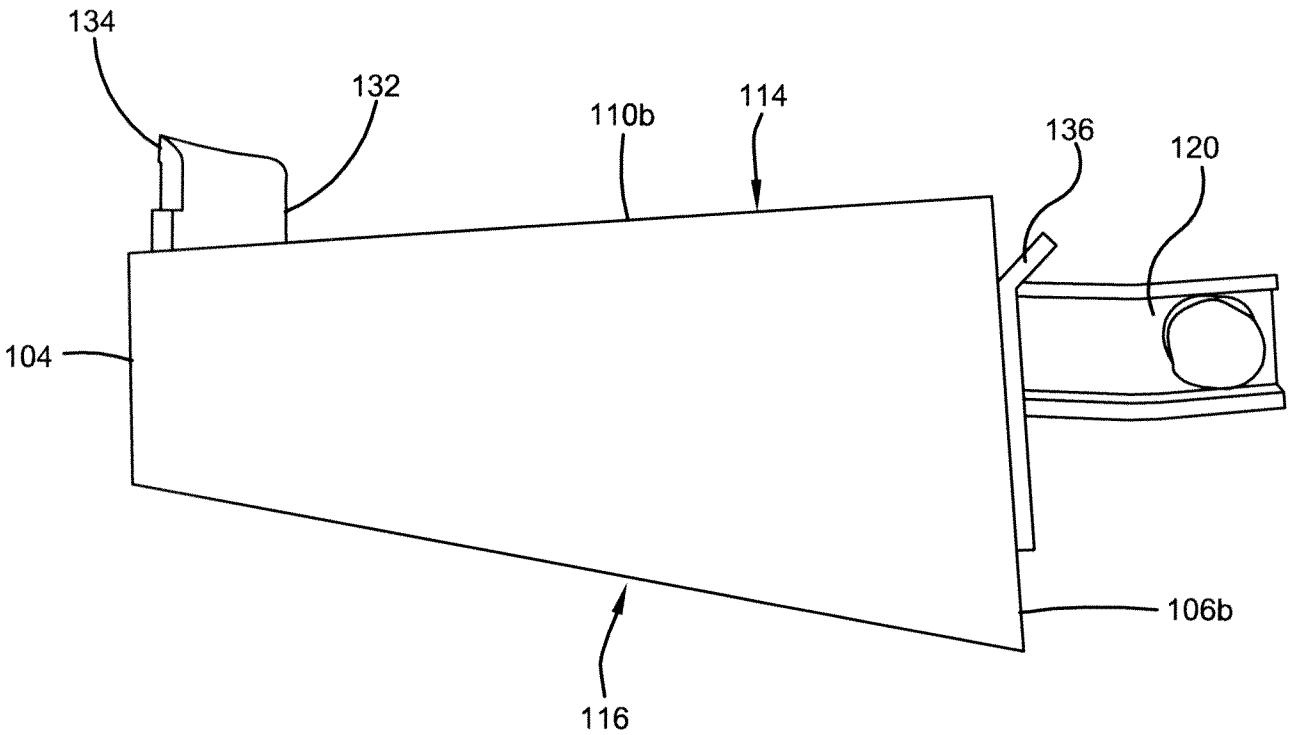
FIG. 5 shows the opposite side view of the magazine well adapter according to one embodiment.
Figure 6:
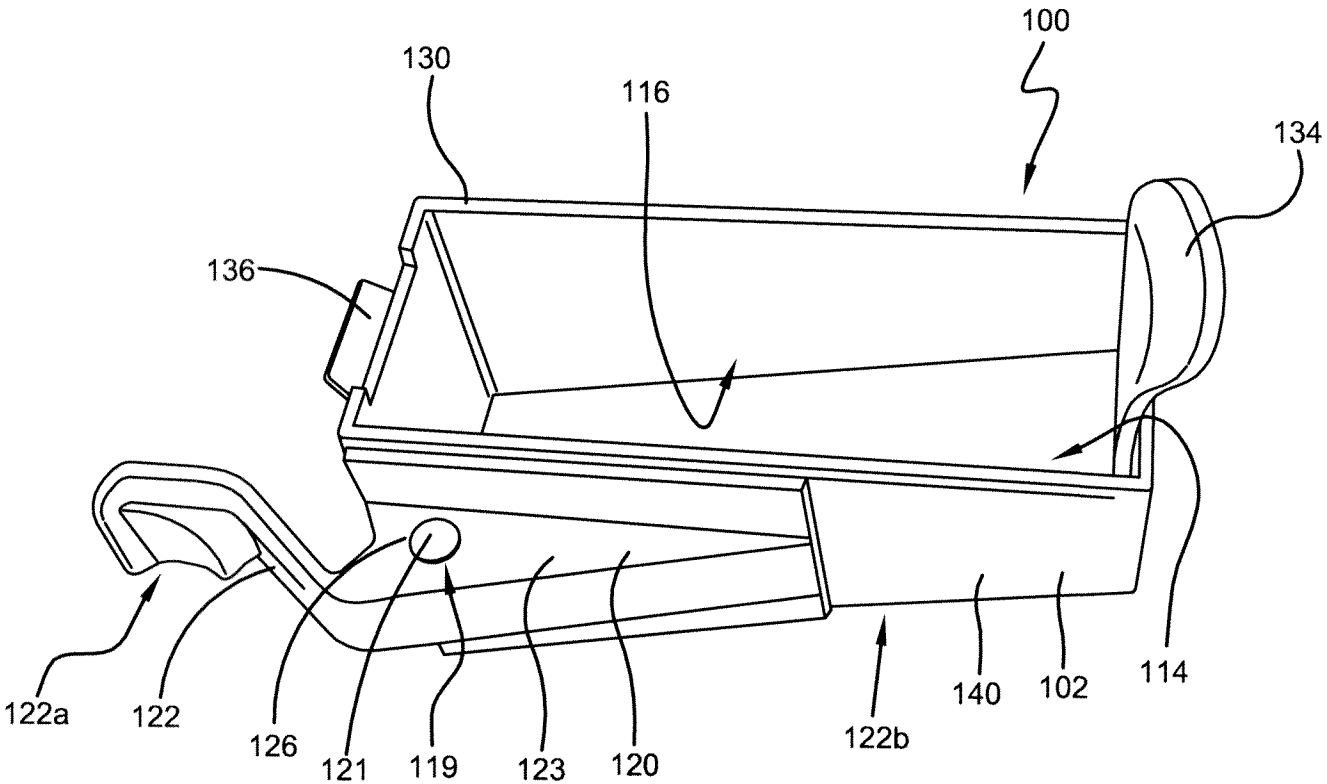
FIG. 6 shows a perspective view of the magazine well adapter according to one embodiment.

Referring now to the drawings wherein the showings are for purposes of illustrating embodiments of the invention only and not for purposes of limiting the same, and wherein like reference numerals are understood to refer to like components, FIGS. 4-7 show an AK-type firearm magazine well adapter 100, according to one or more embodiments of this invention. As shown in FIG. 4, the magazine well adapter 100 has an adapter body 102 and a release mechanism 120. As shown in FIGS. 4 and 6, and further described below, in some embodiments the adapter body 102 has an attachment end 130 with a top opening 114 and design features and dimensions that permit it to be securely and releasably mated ("installed") in an AK-type firearm magazine well 10 without any modification to the firearm's receiver 12. The adapter body 102 also has a receiving end 140 with a bottom opening 116 having dimensions that permit an associated modified ammunition magazine 800 to inserted into, and be secured within, the magazine well adapter 100 and associated magazine well 10.

Figure 7:
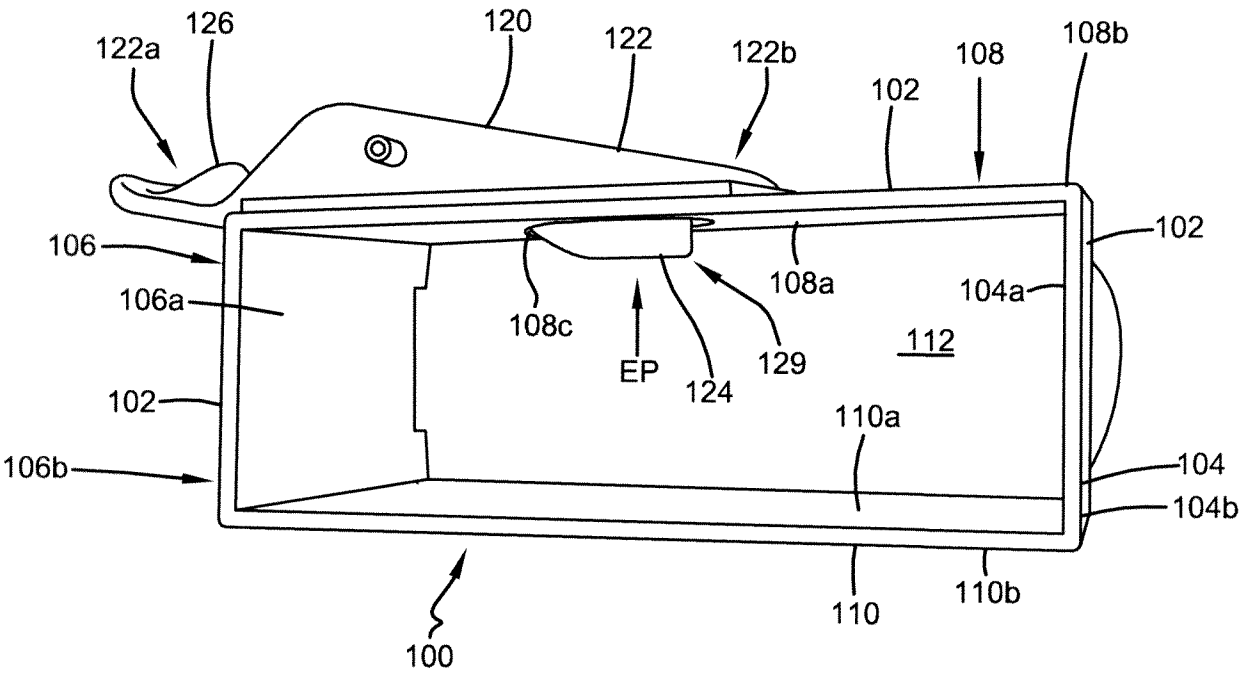
FIG. 7 shows a bottom view of the magazine well adapter, with the release mechanism in an engagement position, according to one embodiment.

As further illustrated in FIG. 7, the adapter body 102 may be comprised of four walls: a front wall 104, a rear wall 106, and two side walls 108, 110. The inner sides of the four walls 104*a*, 106*a*, 108*a*, 110*a* define a magazine cavity 112. The magazine cavity 112 is of a size suitable to operatively receive and secure (collectively, "load") a modified AK-type firearm ammunition magazine 800. In one embodiment, shown in FIGS. 4-8, the magazine cavity 112 is of substantially rectangular shape to accommodate receipt of the modified ammunition magazine 800. In other embodiments, generally shown in FIG. 4, the top opening 114 and bottom opening 116 are both of rectangular shape, but the top opening 114 is smaller than the bottom opening 116. At the attachment end 130, the outer walls 104*b*, 106*b*, 108*b*, 110*b* of the adapter body 102 are of a size and dimension that are substantially identical to, but no smaller than, the size of the magazine well 10.

The assembly and disassembly of the magazine well adapter 100 of the present invention is substantially similar to the process of loading and releasing a traditional tabbed ammunition magazine 8 into an AK-type firearm. Indeed, the attachment end 130 of the magazine well adapter 100 has two design features that mimic the function of a traditional ammunition magazine's engagement tab 88 and magazine catch 90 in order to releasably install the magazine well adapter 100 in much the same way that the traditional tabbed magazine is releasably installed/loaded into an AK-type firearm. With reference now to FIGS. 4-7, the first design feature is the provision of a riser 132 and seating flange 134. The riser is operatively located on or near the front wall 102 and rises above the top opening 114. The seating flange 134 is attached to the riser 132 and is located in a substantially perpendicular position relative to the riser 132, and extends away from the magazine cavity 112. The seating flange 134 acts in much the same manner as the engagement tab 88 of the traditional ammunition magazine 8. The second design feature is the provision of an adapter catch 136, located on the rear wall 106*b* of the adapter body 102 below the top opening 114, that acts in much the same manner as the magazine catch 90 of the traditional ammunition magazine 8.

Figure 9:
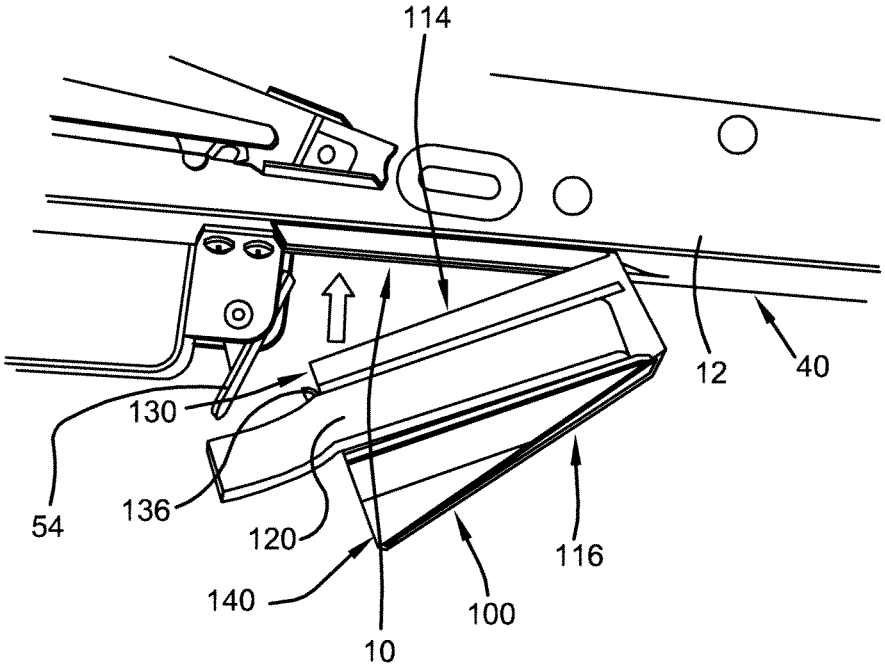
FIG. 9 shows a perspective view of an AK-type firearm and partially assembled magazine well adapter, according to one embodiment.
Figure 10:
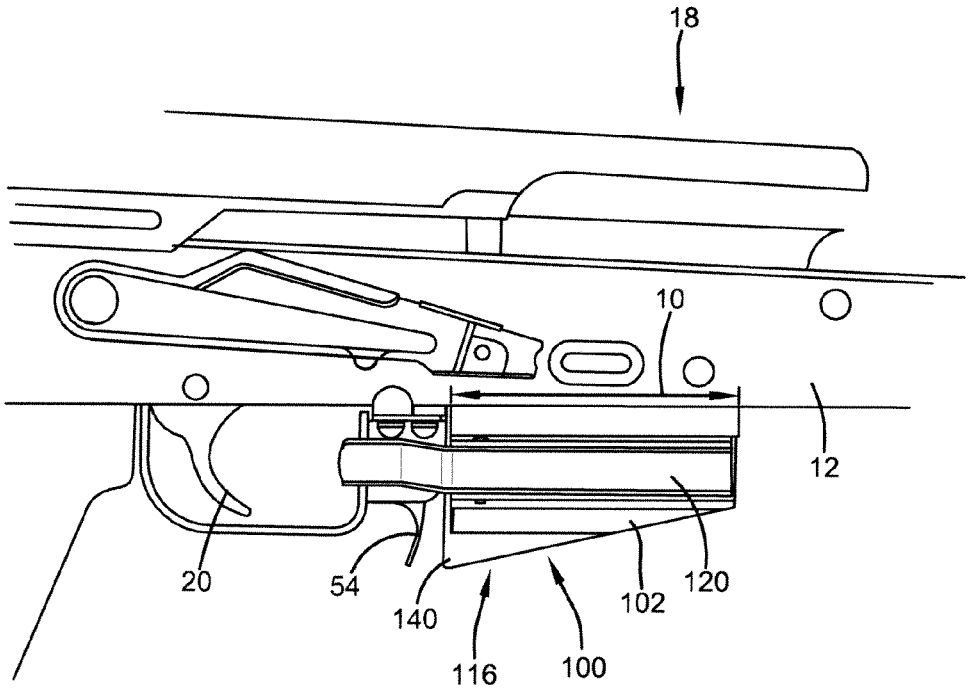
FIG. 10 shows a perspective view of a magazine well adapter fully assembled onto an AK-type firearm, according to one embodiment.

The magazine well adapter 100 of the present invention can be installed and removed from the AK-type firearm without modifying the receiver 12. Much as a traditional tabbed magazine 8 is loaded into an AK-type firearm, the magazine well adapter 100 of the present invention is assembled into the magazine well 10 of an AK-type firearm by tipping the magazine well adapter 100 forward so that the riser 132 and seating flange 134 are situated in close proximity to the portion of the magazine well 100 closest to the firearm's front trunion 40. Next, the seating flange 134 is moved so that it comes into contact with the tab engaging rib 42 of the front trunion 40. The catching of seating flange 134 on the tab engaging rib 42 acts as a pivot point for rotating the magazine well adapter 100 in an upward and rearward direction towards the receiver 12 until the adapter catch 136 snap catches into place above the firearm's magazine latch 54 (as is shown in FIGS. 9 and 10) (pivot seating). The magazine well adapter 100 is removed/disassembled by pressing the magazine latch 54 toward the magazine well adapter 100, and then swinging magazine well adapter 100 forward and in a downward direction out of the magazine well 10 (pivot release).

Figure 11:
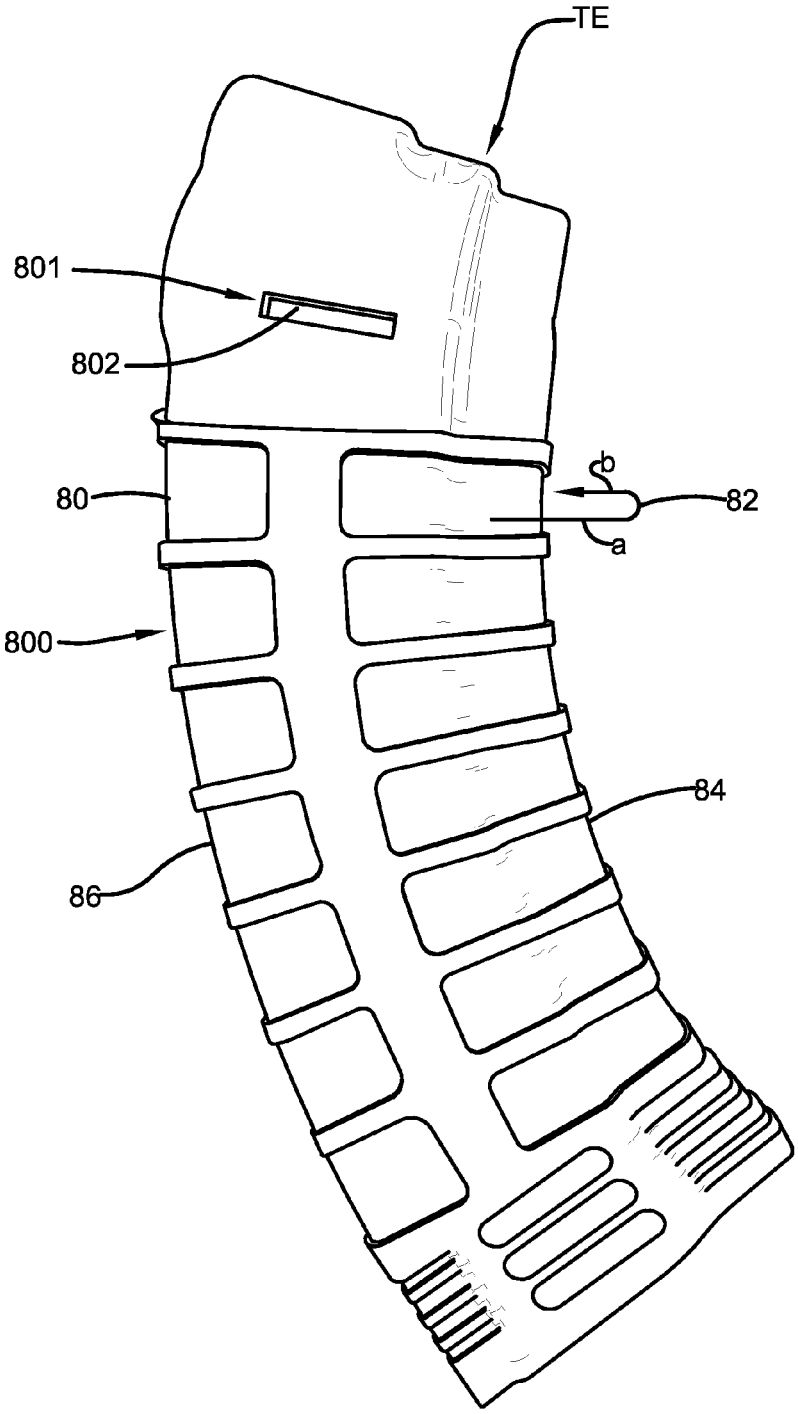
FIG. 11 shows a side view of a modified ammunition magazine of the present invention.

Once the magazine well adapter 100 of the present invention is installed into an AK-type firearm magazine well 10, the AK-type firearm can achieve push-button magazine ejection (drop release) when used in conjunction with a non-tabbed (modified) ammunition magazine 800; in essence, pivot action is no longer necessary during magazine loading or magazine removal. As generally shown in FIG. 11, in one embodiment a modified AK-type ammunition magazine 800 is substantially identical in size and shape to the traditional tabbed magazine 8—with two exceptions. First, the modified magazine 800 does not have the engagement tab 88 and magazine catch 90 of a traditional tabbed AK-47 magazine 8; this permits the modified magazine 800 to be releasably secured within the magazine well 10 by the release mechanism 120 of an installed magazine well adapter 100 (instead of using pivot action, as a traditional magazine 8 would, to seat the magazine 8 within the magazine well 10). Second, the modified magazine 800 has a locking component 801 located on a side wall 82*a*, 82*b*. The locking component 801, as would be appreciated by persons of ordinary skill in the art, can be any feature capable of working with a release mechanism 120 to releasably secure a modified magazine 800 within the magazine well adapter 100 of the present invention. As illustrated in FIG. 11, the locking component 801 of the modified ammunition magazine 800 can be a recessed cutout notch 802 on a side wall 82*a*. The cutout notch 802 works in cooperation with the magazine well adapter 100 release mechanism 120 to permit the modified ammunition magazine 800 to be releasably loaded into the magazine well adapter 100 and magazine well 10.

As shown in FIG. 4, according to one embodiment, a release mechanism 120 is operatively mounted, in a fashion chosen by any person of ordinary skill in the art, on an outer side wall 108*b* of the adapter body 102. According to one embodiment, shown in FIGS. 4-7, the release mechanism 120 has a spring loaded/biased bar 122 with a hole 119 for receiving a pivot pin 121. In one embodiment, the bar has an engagement component 129. In one embodiment, the bar 122 operatively resides within brackets 123—each having apertures 126 for securely receiving pivot pin 12—that are mounted on side wall 108*b*, as is well known in the art. In one embodiment, shown in FIG. 4, the bar 122 has a first end 122*a* with a pressure area 125, in some embodiments also having a finger grip 126, that—in cooperation with the brackets 123 and pivot pin 121—transfers applied pressure so as to pivotably move the engagement component 129. In the embodiment shown in FIGS. 4-7, the engagement component 129 is a cutout tab 124 located on a second end 122*b* of the bar 122. Pivotal movement of the bar 122 causes the cutout tab 124 to move in a manner that releasably engages with (selectively resides within; engaged) (or outside of released) a cutout notch 802 of an associated modified AK-type ammunition magazine 800. In this embodiment, the side wall 108 has an aperture 108*c* of a size and dimension capable of letting the release mechanism's cutout tab 124 pass through the outer wall 108 until it is operatively situated in an engagement position (EP) within the associated modified magazine's 800 cutout notch 802 when the magazine 800 is assembled into a loaded position (LP) within the magazine well adapter 100 and associated magazine well 10. Importantly, the release mechanism 120 can also be interchangeably mounted on side wall 110*b*, so long as the aperture 110*c* (not shown) is located on the same side wall 110, and the cutout notch 802 is located on side wall 82*b*. As would be appreciated by persons of ordinary skill in the art, other release mechanisms 120 capable of cooperating with a modified magazine 800 locking component 801 are contemplated to fall within the scope of this invention.

Figure 12:
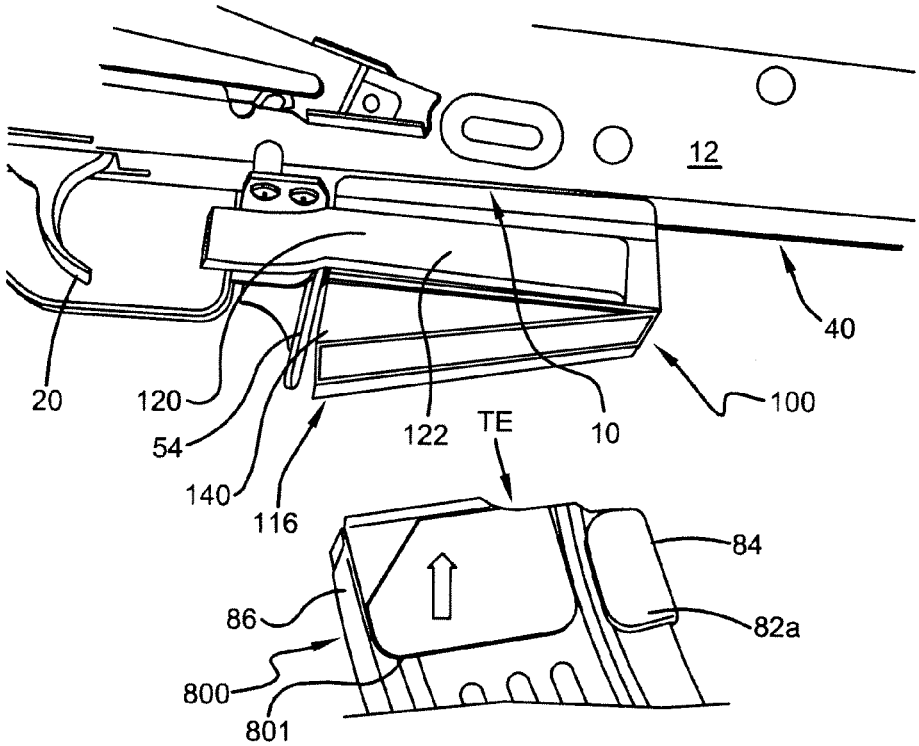
FIG. 12 shows a perspective view of a magazine well adapter fully assembled onto an AK-type firearm, along with a modified ammunition magazine, according to one embodiment.
Figure 13:
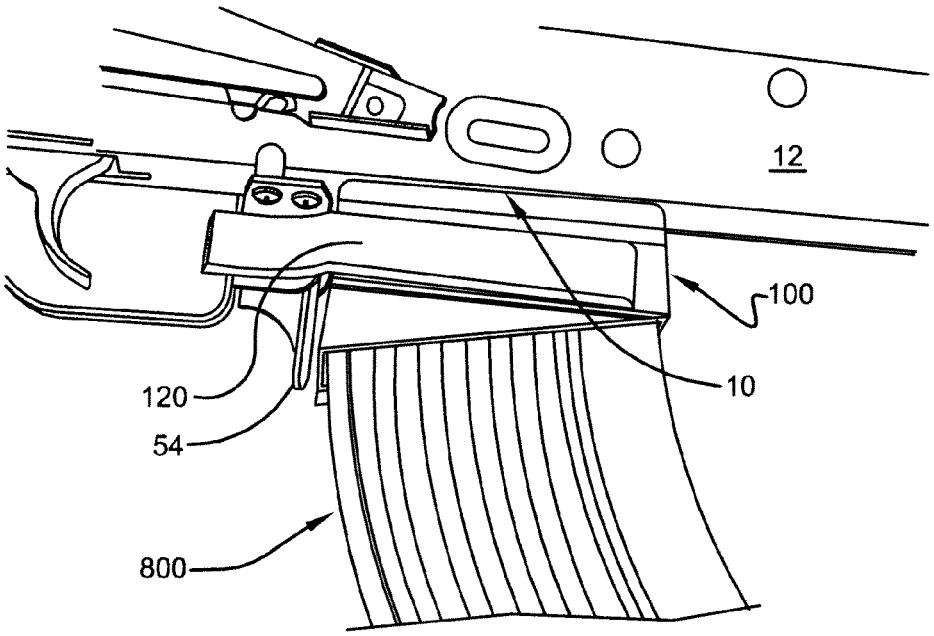
FIG. 13 shows a perspective view of a magazine well adapter fully assembled onto an AK-type firearm, along with a modified ammunition magazine fully assembled/loaded into the magazine well adapter and AK-type firearm magazine well, according to one embodiment.
Figure 14:
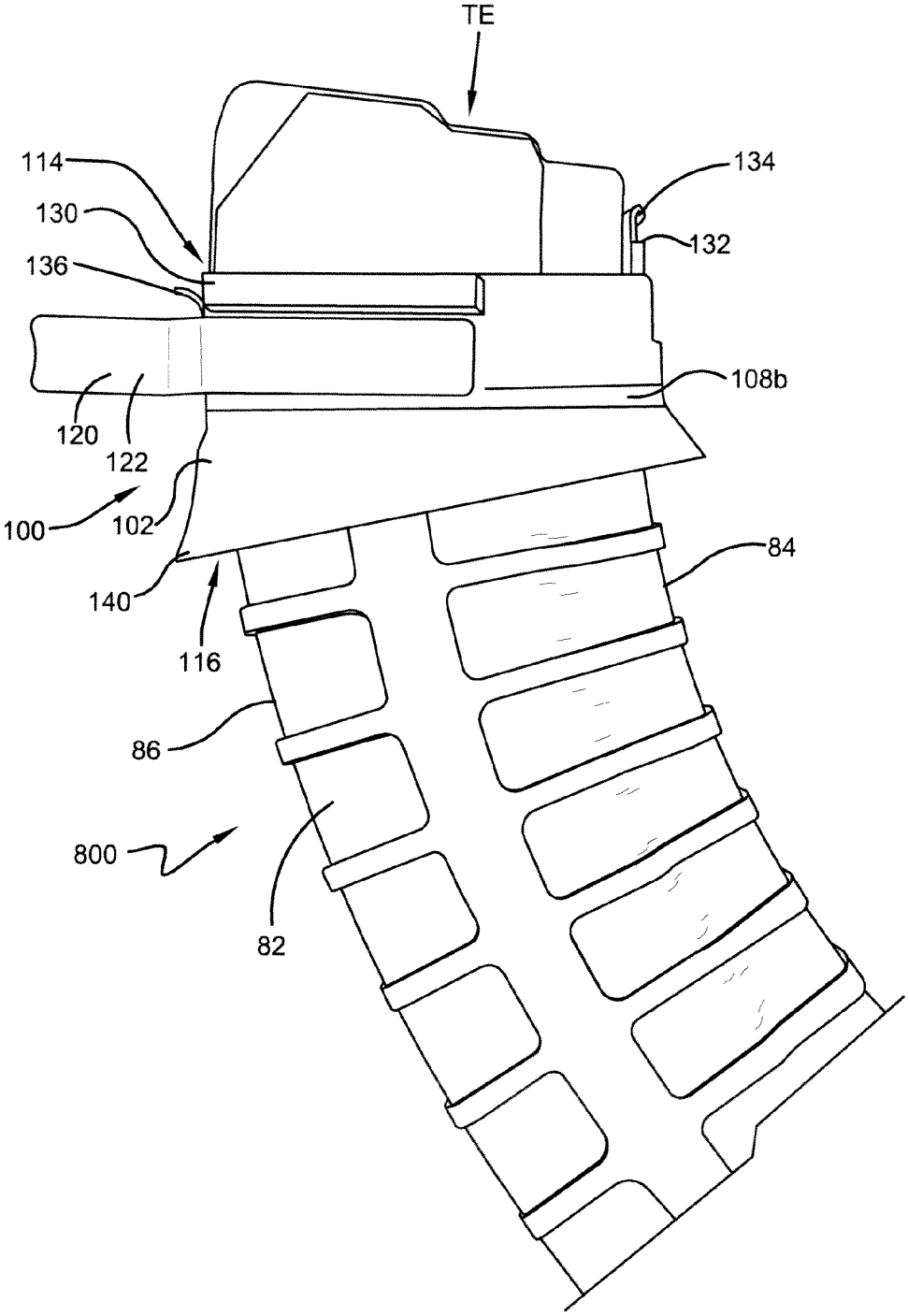
FIG. 14 shows a perspective view of a modified magazine fully assembled/loaded into the magazine well adapter, according to one embodiment.

The loading of a modified magazine 800 into an installed magazine well adapter 100 is shown in FIGS. 12-14. The modified magazine 800 can be releasably secured within the magazine well adapter 100 without pivot action of the magazine 800. The modified magazine is moved substantially straight up until the bar 122 pivots the cutout tab 124 into the cutout notch 802 and the modified magazine 800 becomes releasably secured (loaded) within the magazine well adapter 100 and magazine well 10. Similarly, when the release mechanism 120 is initiates to cause push-button ejection, pivotal movement of the bar 122, such that the cutout tab 124 is removed from its position within the cutout notch 802, causes the modified magazine 800 to drop substantially straight down out of the magazine well 10 and magazine well adapter 100. As is shown in FIG. 14, when the modified magazine 800 is properly loaded into an AK-type firearm's installed magazine well adapter 100, the top end (TE) of the modified magazine 800 has entered into the bottom opening 116 of the magazine well adapter 100, and the release mechanism 120 has engaged the locking component 801 of the magazine housing 80 so as to releasably secure the modified magazine 800 housing 80 within the magazine cavity 112. As is shown in FIGS. 13 and 14, the loaded modified magazine 800 then resides at a depth where the top opening (TE) partially rises above the magazine well adapter's 100 top opening 114, so as to operatively seat the modified magazine 800 within the magazine well 10 in a position where cartridges 34 can be operatively stripped from the modified magazine 800 and chambered by the bolt 32 for discharge during firearm operation, as is well known in the art.

Figure 8:
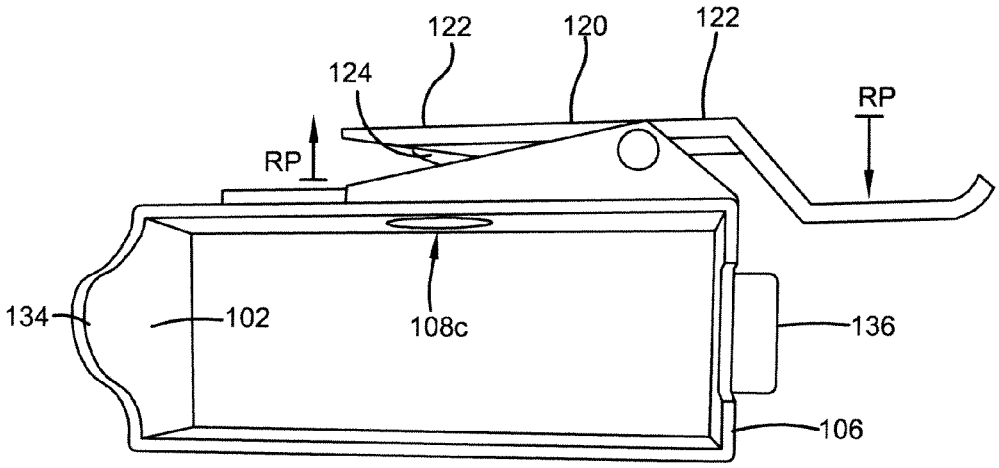
FIG. 8 shows a top view of the magazine well adapter, with the release mechanism in a release position, according to one embodiment.

With the modified magazine 800 properly loaded into the AK-type firearm, the user can fire the weapon until the modified magazine 800 is exhausted of bullets. Push-button drop ejection of the modified magazine 800 is achieved when the user applies pressure to the release mechanism's 120 pressure area 125, or its finger grip 126, to initiate the movement of the bar 122 into a release position (RP). As is illustrated in FIGS. 7 and 8, applying pressure to the pressure area 125 of the spring-loaded bar 122 pivots the cutout tab 124 out of its engagement position (EP) within the magazine cavity 112 and magazine's cutout notch 802, into a release position (RP) at least partially within the aperture 108*c*. With the cutout tab 124 no longer residing within the cutout notch 802, gravity pulls the modified magazine 800*s* down and out of the magazine well 10 and magazine well adapter 100. Because pivot action is not required to load or eject the magazine 800, a new modified magazine 800 can easily be loaded into the magazine well adapter 100 and magazine well 10 without the user removing the AK-type firearm from the shooting position on their shoulder. This efficient reload process, in turn, permits quicker reload, more rounds to be fired, and for target aim to be maintained during reload.

Figure 15:
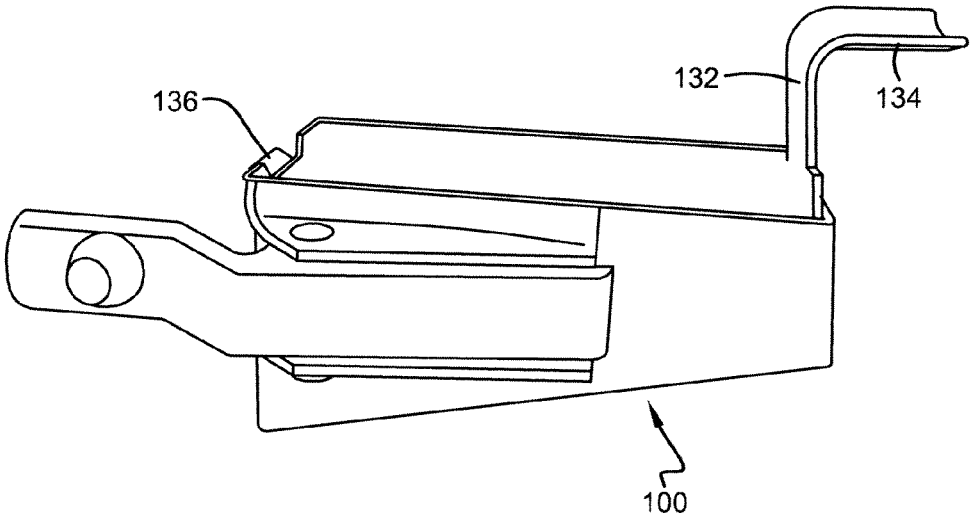
FIG. 15 shows a side view of an embodiment of the magazine well adapter designed for use with a Saiga® assault rifle.

Due to the many variants intended to be covered by the present invention, it should be appreciated that many AK-type firearms—although utilizing functionally equivalent components—have tab engagement ribs 142 and magazine latch's 54 of different design, size, and specific location. Thus, as generally illustrated in FIG. 15, variations to the size and shape of the magazine well adapter's 100 riser 132, seating flange 134, and adapter catch 136 are contemplated to fall within the contours of the present invention. As shown in FIG. 15, by way of just one non-limiting example, a magazine well adapter 100 specifically designed for use with a Saiga® brand 7.62×39 mm assault rifle must accommodate specific design features of the rifle's receiver 12; in this instance, the magazine well adapter's 100 seating flange 134 is of a greater size, and is chamfered so that it may act as a "bullet" guide for properly situating a cartridge 34 for chambering according the specific receiver 12 and trunion 40 configuration of the Saiga® rifle. Other modifications to the magazine well adapter 100 of the present invention may be required to impart the operability detailed above; all such modifications are contemplated to fall within the scope of the invention. Whatever modifications may be required to provide a magazine well adapter 100 for a specific AK-47 variant, however, the present invention permits a non-tabbed modified ammunition magazine 800 to be interchangeably used with an AK-type firearm of identical cartridge dimensions. This will save users money, as various AK-type firearms are designed so that they only work with proprietary magazines designed specifically to engage with their firearm variant receiver 12 and trunion 40 dimensions.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

I claim:

1. An apparatus for use with a semi-automatic rifle, comprising a magazine well adapter having:

an adapter body with an attachment end adapted to be releasably mated with a magazine well of an associated automatic or semi-automatic rifle, a receiving end adapted to receive an associated modified ammunition magazine, and a side wall with an aperture; and a release mechanism, adapted to releasably engage the associated modified ammunition magazine, comprising an engagement component adapted to releasably engage a locking component on an associated modified ammunition magazine wherein the magazine well adapter can be installed onto an associated semi-automatic rifle without any modification to the rifle's receiver, and wherein the adapter body aperture is adapted for the engagement to pass through.

2. The apparatus of claim 1, wherein the release mechanism additionally comprises:

brackets mounted on an outer wall of the adapter body having the aperture, the brackets having apertures adapted to receive a pivot pin;

a spring loaded bar operatively residing within the brackets, the bar having a hole adapted to receive a pivot pin, a first end with a pressure area adapted to receive pressure and effectuate pivotal movement of the bar, a second end with an engagement component adapted to pass through the side wall aperture and releasably engage a locking component on an associated modified ammunition magazine; and a pivot pin.

3. The apparatus of claim 1, wherein the engagement component is a cutout tab adapted to releasably engage a cutout notch on an associated modified ammunition magazine.

4. The apparatus of claim 2, wherein the pressure area additionally comprises a finger grip.

5. The apparatus of claim 1, wherein the adapter body comprises:

a front wall, adapted to operatively mate with a tab engaging rib of an associated semi-automatic rifle's front trunion, comprising a riser extending above the adapter body's top opening, wherein the riser is attached to a seating flange situated on a substantially perpendicular plane relative to the riser, and wherein the seating flange is adapted to releasably pivotally engage with a tab engaging rib of an associated semi-automatic rifle's front trunion;

a rear wall adapted to operatively mate with a magazine latch of an associated semi-automatic rifle; and two side walls, one of which has the release mechanism operatively mounted thereon;

wherein the front wall, rear wall and two side walls define a magazine cavity having a substantially rectangular top opening at the attachment end and a substantially rectangular bottom opening at the receiving end.

6. The apparatus of claim 5, wherein the seating flange is a chamfered bullet guide.

7. The apparatus of claim 5, wherein:

the rear wall additionally comprises an adapter catch adapted to releasably engage with a magazine latch of an associated semi-automatic rifle.

8. The apparatus of claim 5, wherein:

the attachment end's top opening is smaller in size than the receiving end's bottom opening.

9. A kit for use with an associated semi-automatic rifle, comprising:

a magazine well adapter having an adapter body with an attachment end adapted to be received and secured within a magazine well of an associated semi-automatic rifle, and a receiving end adapted to receive an associated modified ammunition magazine;

a release mechanism adapted to releasably engage the associated modified ammunition magazine; and a modified ammunition magazine having an elongated and curved housing having a substantially closed bottom end;

a substantially open top end; and two arcuate side walls connected in opposition by a front wall and a rear wall, wherein at least one side wall has a locking component that is selectively engaged by the magazine well adapter's release mechanism;

wherein the magazine well adapter can be installed onto an associated semi-automatic rifle without any modification to the rifle's receiver.

10. The kit of claim 9, wherein the locking component is a cutout notch adapted to be releasably engaged by the magazine well adapter's release mechanism.

11. The kit of claim 10, wherein the release mechanism is mounted on a side wall of the adapter body having an aperture, and the release mechanism has an engagement component adapted to pass through the side wall aperture and releasably engage with the modified magazine's cutout notch.

12. The kit of claim 11, wherein the engagement component is a cutout tab.

* * * * *